US006749020B1

(12) United States Patent
Knight

(10) Patent No.: US 6,749,020 B1
(45) Date of Patent: Jun. 15, 2004

(54) WELL SCREEN TWO STEP COUPLED CONNECTOR STRUCTURE

(75) Inventor: Patrick C. Knight, Raceland, LA (US)

(73) Assignee: Benoit Machine Inc., Houma, LA (US)

( * ) Notice: Subject to any disclaimer, the term of this patent is extended or adjusted under 35 U.S.C. 154(b) by 80 days.

(21) Appl. No.: 09/985,569

(22) Filed: Nov. 5, 2001

Related U.S. Application Data

(60) Provisional application No. 60/246,094, filed on Nov. 7, 2000.

(51) Int. Cl.[7] ..... E21B 17/00

(52) U.S. Cl. ..... 166/242.6; 166/235; 285/334

(58) Field of Search ..... 285/334, 390, 285/355, 383; 166/378, 381, 235, 242.6; 403/309, 307

(56) References Cited

U.S. PATENT DOCUMENTS

| | | | | | |
|---|---|---|---|---|---|
| 255,469 | A | * | 3/1882 | Smith | 285/334 |
| 2,262,210 | A | * | 11/1941 | Stone | 29/402.13 |
| 3,100,656 | A | * | 8/1963 | AcArthur | 285/55 |
| 3,572,777 | A | * | 3/1971 | Blose et al. | 285/334 |
| 4,018,283 | A | * | 4/1977 | Watkins | 166/278 |
| 4,085,951 | A | * | 4/1978 | Morris | 285/334 |
| 4,253,687 | A | * | 3/1981 | Maples | 285/332.3 |
| 4,496,175 | A | * | 1/1985 | Morris | 285/334 |
| 4,577,895 | A | * | 3/1986 | Castille | 285/334 |
| 4,676,528 | A | * | 6/1987 | Gray | 285/15 |
| 4,705,307 | A | * | 11/1987 | Chelette | 285/332.3 |
| 4,728,129 | A | * | 3/1988 | Morris | 285/334 |
| 4,796,928 | A | * | 1/1989 | Carlin et al. | 285/334 |
| 4,917,409 | A | * | 4/1990 | Reeves | 285/334 |
| 4,928,999 | A | * | 5/1990 | Landriault et al. | 285/113 |
| 5,363,545 | A | * | 11/1994 | Hirano et al. | 29/527.4 |
| 5,419,595 | A | * | 5/1995 | Yamamoto et al. | 285/334 |
| 5,423,579 | A | * | 6/1995 | Blose et al. | 285/334 |
| 5,454,605 | A | * | 10/1995 | Mott | 285/333 |
| 5,794,985 | A | * | 8/1998 | Mallis | 285/93 |
| 5,868,200 | A | * | 2/1999 | Bryant et al. | 166/51 |
| 5,881,809 | A | * | 3/1999 | Gillespie et al. | 166/233 |
| 6,347,814 | B1 | * | 2/2002 | Cerruti | 285/334 |
| 6,481,760 | B1 | * | 11/2002 | Noel et al. | 285/334 |

FOREIGN PATENT DOCUMENTS

| | | | | |
|---|---|---|---|---|
| WO | WO 8402947 A1 | * | 8/1984 | E21B/17/042 |

* cited by examiner

*Primary Examiner*—David Bagnell
*Assistant Examiner*—Daniel P Stephenson
(74) *Attorney, Agent, or Firm*—Nixon Peabody LLP; Donald R. Studebaker

(57) ABSTRACT

The well screen two step coupled connector and method includes providing a well screen with a then walled tubular pin having a constant diameter channel and three pin sections of successively increasing diameter. The end of the pin has an annular surface and an angled recess is provided between the intermediate and innermost pin sections, while non-inclined external threads are formed on the end and intermediate pin sections. A tubular open ended coupling is provided having a passage divided into two coupling sections by an inwardly projecting divider. Each coupling section is configured to receive the end and intermediate pin sections and includes non-inclined threads to mate with the pin section threads. The coupling includes an angled wall adjacent the divider to provide a seal with the annular angled surface at the end of the pin and an angled projection which fits within and forms a seal with the angled recess in the pin.

11 Claims, 2 Drawing Sheets

WELL SCREEN TWO STEP COUPLED CONNECTOR STRUCTURE

This application is based upon provisional application Serial No. 60/246,094 filed Nov. 7, 2000 now abandoned.

BACKGROUND OF THE INVENTION

Oil and gas wells often include lengths of tubular screen material at the lower section of the production tubing string to filter sand and other debris from the oil or gas produced. Often several lengths of screen are coupled to each other and to the tubing string. These couplings conventionally include tapered, interference type threads, and are formed with chrome and nickel alloy steels. This interference fit causes make-up problems and thread galling. With tapered, interference threads, it is difficult to achieve the initial coupling by hand, and the use of rig tongs is required. When it becomes necessary to remove and reinstall the coupling, interference threads tend to bind and tear.

In the past, non-tapered non-interference threads have been used in the direct coupling of high strength, heavy walled well casing sections for use in extremely long casing strings for deep, critical high pressure environments. These applications involve large diameter, thick walled tubing sections which are either directly threaded together or joined by a thin walled coupling member as exemplified by couplings developed by Hydril. Such couplings have not been considered to be feasible for small diameter, thin walled tubing such as that used in well screen section couplings.

SUMMARY OF THE INVENTION

It is a primary object of the present invention to provide a novel and improved well screen coupled connection which includes a two step coupled joint with non-tapered, non-interference threads.

A further object of the present invention is to provide a novel and improved well screen coupled connection with non-tapered, non-interference threads and positive metal-to-metal seals formed on the thin walled, small diameter coupling pins for well screen sections.

Another object of the present invention is to provide a novel and improved well screen section and coupling combination to facilitate suspension of a well screen section over a well head during manual coupling thereof with another well screen section.

These and other objects of the present invention are obtained by providing a well screen two step coupled connector and method which includes a well screen with a thin walled tubular pin having a constant diameter channel and three pin sections of successively increasing diameter. The end of the pin has an annular angled surface and an angled recess is provided between the intermediate and innermost pin sections, while non-inclined external threads are formed on the end and intermediate pin sections. A tubular open ended coupling is provided having a passage divided into two coupling sections by an inwardly projecting divider. Each coupling section is configured to receive the end and intermediate pin sections and includes non-inclined threads to mate with the pin section threads. The coupling includes an angled wall adjacent the divider to provide a seal with the annular angled surface at the end of the pin and an angled projection which fits within and forms a seal with the angled recess in the pin.

DESCRIPTION OF THE PREFERRED EMBODIMENT

Figure 1:
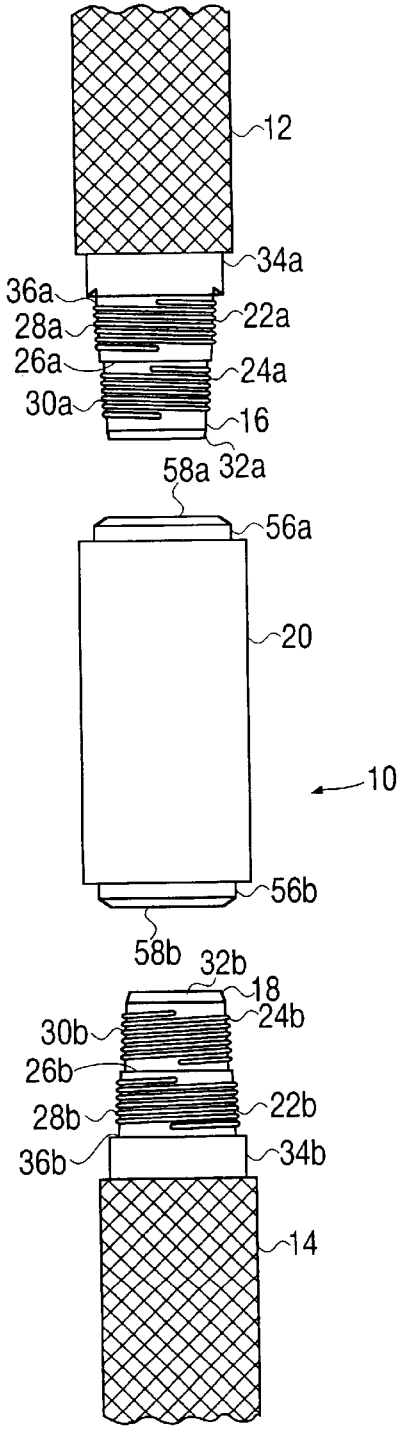
FIG. 1 is an exploded view in front elevation of the well screen two step coupled connection of the present invention.
Figure 2:
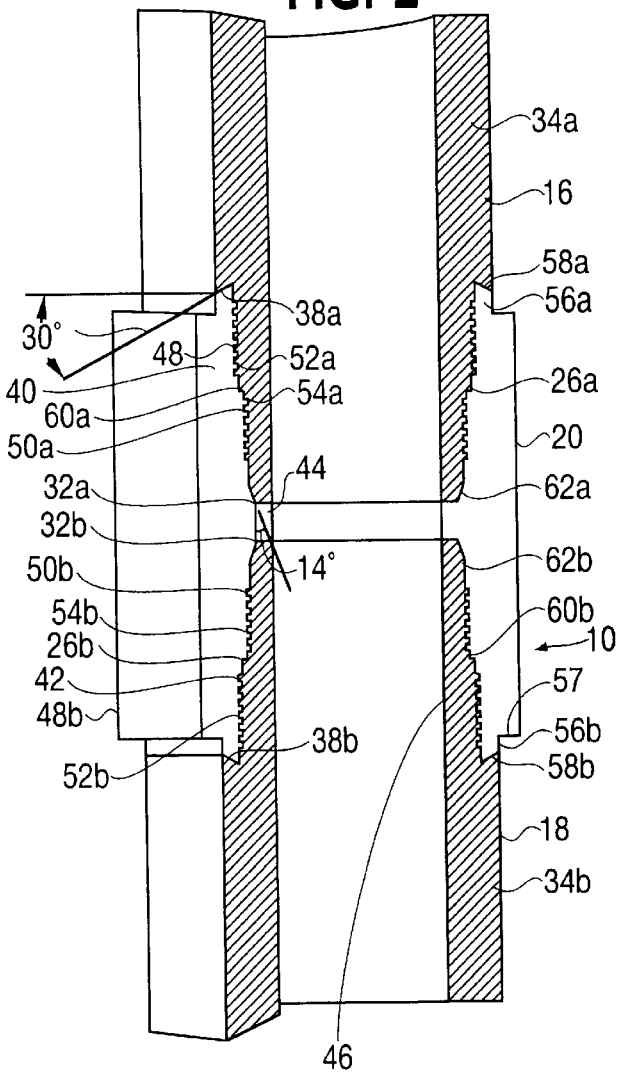
FIG. 2 is a sectional view of the well screen two step coupled connection of the present invention.
Figure 3:
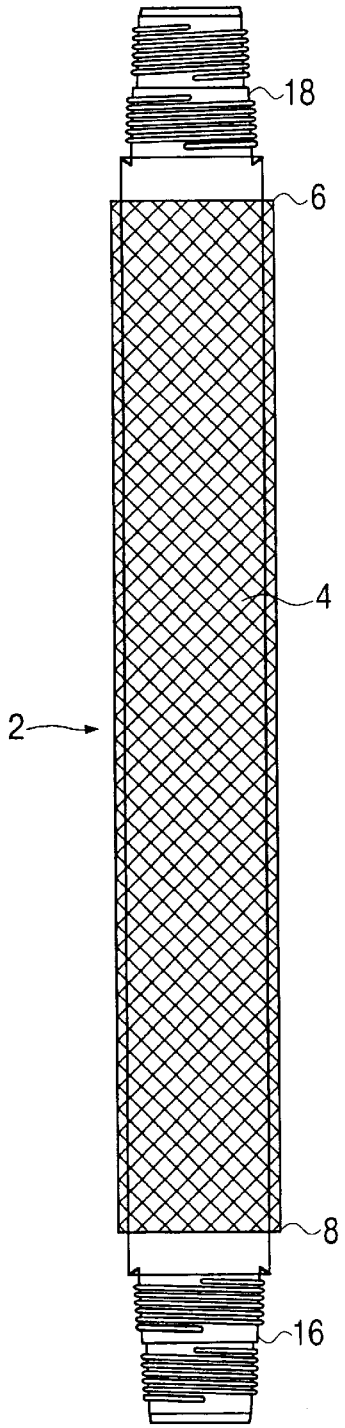
FIG. 3 is a view in front elevation of a well screen section with the two step coupled connection pins.

Referring to the drawings, the well screen section 2 of the present invention includes a tubular length of perforated screen 4 which is welded at either end 6 and 8 to thin walled coupling pins. The well screen two step coupled connection indicated generally at 10 includes an upper tubular well screen section 12 and a lower tubular well screen section 14. These well screen sections each include an externally threaded, lower, tubular pin 16 and a threaded upper tubular pin 18 which are engaged by a thick walled coupling 20 to secure the upper well screen section to the lower well screen section.

The internal configuration of the coupling 20 and external configurations of the threaded lower pin 16 and upper pin 18 are designed to provide a two step coupled joint. Since the external configurations of the upper and lower pins are identical, the same reference numerals will be used to designate identical components with the lower pin reference numerals bearing the letter "a" and the upper pin reference numerals bearing the letter "b".

It will be noted that the tubular pins 16 and 18 are formed in two sections 22 and 24 with the section 22 having a greater diameter and thicker pin wall than the section 24. This results in a substantially ninety degree shoulder 26 formed between the sections 22 and 24.

The sections 22 and 24 bear threads 28 and 30 respectively. These are spaced, non-inclined threads which do not provide an interference fit when they mate with similar threads. The terminal end of section 24 spaced outwardly from the threads 30 is provided with an annular tapered portion 32 which is angled at substantially a fourteen degree angle.

The pins 16 and 18 are increased in diameter relative to the section 22 to provide an enlarged section 34 having a thicker pin wall at the innermost end of the section 22 spaced from the threads 28. An angled recess 36 is formed in the end of the section 34 at the innermost end of the section 22 to provide a contact surface 38 angled to substantially a reverse angle of thirty degrees.

The coupling 20 is formed to provide two metal to metal seals with the pins 16 and 18, one for internal pressure resistance and one for external pressure resistance. The coupling is provided with an upper section 40 to receive the lower pin 16 and a lower section 42 to receive the pin 18. The sections 40 and 42 are separated by an inwardly projecting shoulder 44. Since the configuration of the coupling sections 40 and 42 are substantially identical, the same reference numerals will be used to designate like structural elements with the letter "a" being used for elements in coupling section 40 and the letter "b" being used for elements in the coupling section 42.

A central channel or passage 46 extends through the coupling 20, and the interior surfaces of this channel are configured to receive and conform to the outer surfaces of the pins 16 and 18. Thus the upper and lower sections 40 and 42 have an interior surface section 48 extending inwardly from the opposed open ends of the coupling which is of a greater diameter than the diameter of an interior surface section 50. The interior surface sections 48 and 50 are threaded at 52 and 54, and these are spaced, non-inclined threads which are designed to provide a non-interference fit when they mate with the threads 22 and 24.

The coupling includes outwardly projecting end sections 56 having an outer diameter which is substantially equal to the outer diameter of the end sections 34 but is less than the outer diameter of the remaining portion of the coupling body forming a 90° shoulder 57 between the two diameters. This shoulder 57 provides a support to suspend one length of well screen above the well bore during make-up to the next length. Each end section has an inwardly angled end surface 58 which matches and tightly engages the contact surface 38 to form a tight metal to metal seal. It will be noted that the end sections at 58 project into and are enclosed within the angled recesses 36.

Since the interior surface sections 48 and 50 are of different diameters, a substantially ninety degree shoulder 60 is formed therebetween and positioned to form a reserve torque shoulder. Also, directly adjacent to the shoulder 44, the surface of the interior surface sections 48 and 50 angles outwardly at 62 to conform to and tightly engage the angled annular tapered portion 32 to create another metal to metal seal.

The non-tapered, non-interference threads permit the coupling 20 to be threaded by hand onto the pin of a well screen to near complete make up. Similarly the coupling can be easily removed and reapplied a number of times without having the threads bind or gall. Once the coupling is made up to power-tight position, two metal to metal seals are formed between the surfaces 38 and 58, and the surfaces 32 and 62.

It will be noted that the wall thickness of the tubular pins 16 and 18 in threaded sections 22 and 24 which are received in the coupling 20 are much less than the wall thickness of the coupling 20 to insure that the coupling will provide strength to the threaded tubular pins. It is preferable that the wall thickness of the coupling be at least twice the wall thickness of the threaded sections 22 and 24.

To permit two well screen sections 12 and 14 to be easily coupled together, the coupling 20 is first tightened by hand onto the threaded upper pin 18 of the well screen section 14. The coupling is then power tightened to form metal to metal seals between the surfaces 38*b* and 58*b* and 32*b* and 62*b*. The seal between surfaces 38*b* and 58*b* is an external torque shoulder seal and between the surfaces 32*b* and 62*b* is an internal pressure seal.

Figure 4:
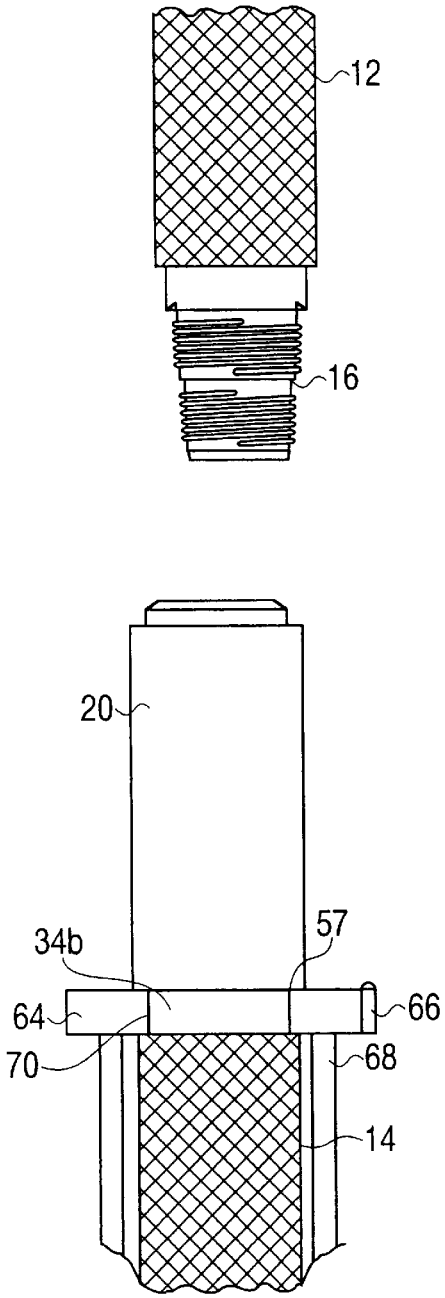
FIG. 4 shows a front elevational view of a coupled well screen section of FIG. 1 supported on a well head for coupling with a second well screen section.

With the coupling in place on the well screen section 14 as shown in FIG. 4, a plate 64 (shown in section) formed in two sections hinged together at 66 is placed across a well head 68. Each section of the plate includes an arcuate cutout positioned such that when the hinged plate sections are brought together, a circular opening 70 is formed. The circular opening 70 is dimensioned to fit around the section 34*b* while allowing the shoulder 57 of the coupling 20 to rest on the upper surface of the plate. In this manner, the screen section 14 is suspended above the well bore while the coupling 20 is positioned to receive and facilitate hand tightening of the pin 16.

The pin 16 is now inserted into the coupling 20, and the coupling is rotated by hand to hand tighten the connection between the pin 16 and the coupling. Then the coupling is power tightened to form metal to metal seals between the surfaces 38*a* and 58*a* and 32*a* and 62*a*.

I claim:

1. A well screen two step coupled connector structure comprising:

first and second well screen sections to be coupled, each of said first and second well screen sections including a tubular length of perforated screen and a first tubular coupling pin secured to a first end of said tubular length of perforated screen, said first tubular coupling pin having an outer end section of a first outer diameter terminating at a free coupling pin end and spaced, non-inclined pin threads formed externally on said outer end section and spaced from the free coupling pin end thereof, said free coupling pin end terminating in an annular angled surface, an intermediate section of a greater outer diameter than said outer end section to form a shoulder therebetween and spaced, non-inclined pin threads formed externally on said intermediate section, and an inner end section of a greater outer diameter than said intermediate section to form a stepped shoulder therebetween having an end surface inclined inwardly toward said inner end section to form an angled recess at an innermost end of said intermediate section, and a tubular open ended coupling having a central passage extending therethrough between first and second ends thereof which is divided into first and second coupling sections by an inwardly projecting divider for receiving the first tubular coupling pins of said first and second well screen sections respectively, the central passage in said first and second coupling sections including an innermost section adjacent to said inwardly projecting divider having a diameter sufficient to receive the outer end section of said first tubular coupling pin and internal, non-inclined coupler threads formed in said innermost section to engage the external non-inclined pin threads formed on said outer end section and an outermost section having a larger diameter than that of the innermost section which is sufficient to receive the intermediate section of said first tubular coupling pin and internal non-inclined coupler threads formed in said outermost section to engage the external non-inclined pin threads formed on said intermediate section, said central passage in said first and second coupling sections angling inwardly at said inwardly projecting divider to provide an angled sealing surface to engage the annular angled surface of the free coupling pin end for said first tubular coupling pin, said tubular open ended coupling including an annular projection formed at the first and second ends thereof to project into the angled recess at the innermost end of the intermediate section of said first tubular coupling pin, said annular projection having an angled end wall to engage and provide an angled sealing surface with said angled recess, wherein the outer diameter of said annular projection is less than the outer diameter of the remainder of said tubular open ended coupling to form a support shoulder to provide support to suspend one length of perforated screen during the makeup of the next length of perforated screen.

2. The well screen two step coupled connector structure of claim 1, wherein the support shoulder forms a 90° shoulder between the outer diameter of said annular projection and the outer diameter of the remainder of said tubular open ended coupling.

3. The well screen two step coupled connector structure of claim 1, wherein the outer diameter of said annular projection is substantially equal to the outer diameter of the inner end section of said first tubular coupling pin.

4. The well screen two step coupled connector structure of claim 1, wherein said first and second well screen sections include a second tubular coupling pin secured to a second end of said tubular length of perforated screen, the structure of said second tubular coupling pin being substantially identical to the structure of said first tubular coupling pin.

5. The well screen two step coupled connector structure of claim 1 wherein said first tubular coupling pin includes a pin wall in said intermediate section which is thicker than a pin wall in said outer end section.

6. The well screen two step coupled connector structure of claim 5 wherein said tubular open ended coupling includes a coupling wall having a thickness which is greater than the thickness of the pin walls in said intermediate and outer end sections.

7. The well screen two step coupled connector structure of claim 6 wherein said tubular open ended coupling includes a coupling wall having a thickness which is at least twice the thickness of the pin walls in said intermediate and outer end sections.

8. The well screen two step coupled connector structure of claim 5 wherein said first tubular coupling pin includes a pin wall in said inner end section which is thicker than the pin walls in said intermediate and outer end sections.

9. The well screen two step coupled connector structure of claim 8 wherein the outer diameter of said annular projection is substantially equal to the outer diameter of the inner end section of said first tubular coupling pin.

10. A well screen two step coupled connector structure for connecting well screens comprising:

a tubular coupling pin to be secured to an end of a well screen, said tubular coupling pin having an outer end section with a pin wall of a first outer diameter terminating at a free coupling pin end and spaced, non-inclined pin threads formed externally on said outer end section and spaced from the free coupling pin end thereof, said free coupling pin end terminating in an annular angled surface, an intermediate section with a pin wall of a greater thickness and a greater outer diameter than that of said outer end section to form a shoulder therebetween and spaced, non-inclined pin threads formed externally on said intermediate section, and an inner end section with a pin wall of a greater thickness and a greater outer diameter than that of said intermediate section to form a stepped shoulder therebetween having an end surface inclined inwardly toward said inner end section to form an angled recess at an innermost end of said intermediate section, and a tubular open ended coupling defining a passage extending therethrough between first and second ends thereof which is divided into first and second coupling sections by an inwardly projecting divider, said first and second coupling sections each being configured to receive the outer end section and intermediate section of a tubular coupling pin, the passage in a coupling section including an innermost section adjacent to said inwardly projecting divider having a diameter sufficient to receive the outer end section of a tubular coupling pin and internal, non-inclined coupler threads formed in said innermost section to engage the external non-inclined pin threads formed on said outer end section, and an outermost section having a larger diameter than that of the innermost section which is sufficient to receive the intermediate section of said tubular coupling pin and internal non-inclined coupler threads formed in said outermost section to engage the external non-inclined pin threads formed on said intermediate section, said passage in said first and second coupling sections angling inwardly at said inwardly projecting divider to provide an angled sealing surface to engage the annular angled surface of the free coupling pin end for said tubular coupling pin, said tubular open ended coupling including an annular projection formed at the first and second ends thereof to project into the angled recess at the innermost end of the intermediate section of a tubular coupling pin, said annular projection having an angled end wall to engage and provide an angled sealing surface with said angled recess, wherein the outer diameter of each annular projection is less than the outer diameter of the remainder of said tubular open ended coupling to form a support shoulder to provide support to suspend one length of a perforated screen of a well screen during the makeup of the next length of a perforated screen of a well screen.

11. The well screen two step coupled connector structure of claim 10, wherein each support shoulder forms a 90° shoulder between the outer diameter of each annular projection and the outer diameter of the remainder of said tubular open ended coupling.

* * * * *